US007757629B2

(12) United States Patent
Lydon et al.

(10) Patent No.: US 7,757,629 B2
(45) Date of Patent: Jul. 20, 2010

(54) METHOD AND APPARATUS FOR COATING AN OPTICAL ARTICLE

(75) Inventors: Michael T. Lydon, Seminole, FL (US); William P. Blackburn, Safety Harbor, FL (US); Ernesto Maldonado, Tarpon Springs, FL (US); James R. Kausch, Indian Rocks Beach, FL (US); Lex E. Pace, Largo, FL (US)

(73) Assignee: Transitions Optical, Inc., Pinellas Park, FL (US)

( * ) Notice: Subject to any disclaimer, the term of this patent is extended or adjusted under 35 U.S.C. 154(b) by 1070 days.

(21) Appl. No.: 11/105,827

(22) Filed: Apr. 14, 2005

(65) Prior Publication Data

US 2006/0231022 A1 Oct. 19, 2006

(51) Int. Cl.
*B05B 13/02* (2006.01)

(52) U.S. Cl. ..... 118/324; 118/410; 118/DIG. 4

(58) Field of Classification Search ..... 118/410, 118/324, DIG. 544; 427/420; 198/867.01, 198/867.13

See application file for complete search history.

(56) References Cited

U.S. PATENT DOCUMENTS

| | | | | |
|---|---|---|---|---|
| 3,132,966 | A * | 5/1964 | Hughes et al. | 427/498 |
| 3,242,003 | A * | 3/1966 | Brown | 427/420 |
| 3,341,354 | A * | 9/1967 | Gordy et al. | 427/288 |
| 3,383,054 | A * | 5/1968 | Nugarus | 239/597 |
| 3,500,610 | A * | 3/1970 | Barnard et al. | 53/140 |
| 3,830,608 | A * | 8/1974 | Sebastian | 425/103 |
| 3,876,465 | A * | 4/1975 | Prazak, III | 427/64 |
| 4,961,965 | A | 10/1990 | Dietz | |
| 5,114,740 | A | 5/1992 | Plate et al. | |
| 5,246,499 | A | 9/1993 | Peralta et al. | |
| 5,900,273 | A | 5/1999 | Rasmussen et al. | |
| 6,033,718 | A | 3/2000 | Marias Albrich et al. | |
| 6,379,776 | B1 | 4/2002 | Tada et al. | |
| 2005/0244571 | A1 | 11/2005 | Walheim et al. | |

* cited by examiner

*Primary Examiner*—Brenda A Lamb
(74) *Attorney, Agent, or Firm*—Frank P. Mallak; Linda Pingitore; Deborah M. Altman

(57) ABSTRACT

Methods and apparatus for coating optical articles, such as optical lenses, are provided. In one aspect, an optical article is placed in a holder and a sheet of coating material is discharged from a nozzle, such as from a fan coater nozzle, onto the optical article to form a coating on the optical article.

7 Claims, 2 Drawing Sheets

METHOD AND APPARATUS FOR COATING AN OPTICAL ARTICLE

BACKGROUND OF THE INVENTION

The present invention relates generally to methods and apparatus for coating articles, such as optical articles, such as but not limited to optical lenses.

Optical lenses, such as glass or plastic lenses for conventional eyeglasses, are in wide use today. A functional coating may be applied to the surface of these lenses to provide the lenses with certain desired properties, such as improved mar and scratch resistance, antireflection properties, or polarization properties, just to name a few. These coatings are typically applied using a spin coating technique in which a liquid coating material is deposited in the middle of the lens while the lens is spinning. Centrifugal force causes the coating material to spread out over the surface of the spinning lens. The lens is then stopped and the coating material cured, such as by heating or air-drying, to form a coated lens.

While adequate for most uses, this spin coating technique does have some drawbacks. For example, this spin coating technique may lead to non-uniform coating thickness across the lens surface, e.g., the coating applied by a spin coating technique may be thicker at the edges of the lens than in the middle of the lens due to centrifugal force directing the coating flow outwardly from the center of the lens to the edge of the lens. For functional coatings, this may lead to a difference in performance across the lens surface. Additionally, the spin coating technique is not well suited for coating multi-focal lenses. By "multi-focal lenses" is meant lenses having more than one focal prescription, such as conventional bifocal or trifocal lenses. In these multi-focal lenses, there is typically an edge between one focal prescription and the other focal prescription(s) such that the surface of the lens is uneven, i.e., not of uniform curvature or flatness across the lens surface. Spin coating may lead to pooling or disruption of the coating flow at these uneven surface regions. Moreover, conventional spin coaters are relatively complex in design because the holder in which the lenses are placed must be capable of rotating the lenses at a predetermined speed during the spin coating process. Additionally, the time required to start the lens spinning before coating and then to stop the lens after coating decreases the coating efficiency and throughput of the spin coater.

Therefore, it would be advantageous to provide a method and/or apparatus for coating articles, such as optical lenses, which eliminates or reduces at least some of the problems associated with conventional spin coating.

SUMMARY OF THE INVENTION

A method of coating an optical article comprises placing an optical article in a holder, and providing a non-atomized sheet of coating material dispersed under pressure to form a coating over the optical article. In one non-limiting embodiment, the coating material is dispersed from a pressure coater, e.g., a flow coater, such as a fan coater.

Another method of coating an optical article comprises placing an article in a holder, providing a non-atomized sheet of coating material from a fan coater nozzle, and moving the holder in a predetermined path relative to the coating material sheet to apply a coating onto the optical article. In one embodiment, the predetermined path is a straight path. In another embodiment, the predetermined path is a non-linear, e.g., curved, path.

An apparatus for coating an optical article comprises a holder configured to hold an optical article; a coating applicator having a nozzle configured to supply a non-atomized sheet of coating material; and a movement device configured to move the holder through the coating material sheet to apply a coating of the coating material over at least a portion of the article.

Another apparatus for coating optical lenses comprises a lens holder configured to hold a lens; a rotary device; a support, such as an arm, having a first end connected to the lens holder and a second end connected to the rotary device; and a fan coating applicator having a nozzle configured to supply a fan-shaped sheet of non-atomized coating material. The apparatus is configured such that the rotary device causes the lens holder to pass through the coating sheet in a non-linear, e.g., curved, path.

DESCRIPTION OF THE INVENTION

Figure 1:
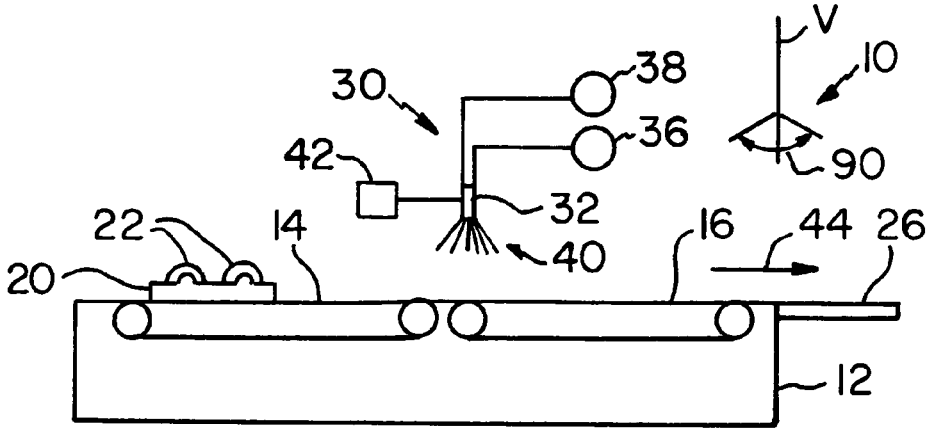
FIG. 1 is a side, schematic view (not to scale) of a first coating device of the invention.

As used herein, spatial or directional terms, such as "left", "right", "vertical", "horizontal", "above", "below", and the like, relate to the invention as it is shown in the drawing figures. However, it is to be understood that the invention may assume various alternative orientations and, accordingly, such terms are not to be considered as limiting. Further, as used herein, all numbers expressing dimensions, physical characteristics, processing parameters, quantities of ingredients, reaction conditions, and the like, used in the specification and claims are to be understood as being modified in all instances by the term "about" unless indicated to the contrary. Accordingly, unless indicated to the contrary, the numerical values set forth in the following specification and claims may vary depending upon the desired properties sought to be obtained. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass the beginning and ending range values and any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 3.3, 4.7 to 7.5, 5.5 to 10, and the like. Further, as used herein, the terms "formed over", "deposited over", or "applied over" mean formed, deposited, or applied on but not necessarily in contact with the surface. For example, a coating "formed over" a substrate does not preclude the presence of one or more other coatings of the same or different composition located between the formed coating and the substrate. As used herein, the terms "polymer" or "polymeric" refer to oligomers, homopolymers, copolymers, and terpolymers, e.g., polymers formed from two or more types of monomers or polymers. The terms "visible region" or "visible light" refer to electromagnetic radiation having a wavelength in the range of 380 nm to 800 nm. The terms "infrared region" or "infrared radiation" refer to electromagnetic radiation having a wavelength in the range of greater than 800 nm to 100,000 nm. The terms "ultraviolet region" or "ultraviolet radiation" mean electromagnetic energy having a wavelength in the range of 300 nm to less than 380 nm. By "non-atomized" coating sheet is meant that the coating material is not atomized, i.e., purposely mixed with air, as in a conventional spray coating method, to form a plurality of individual coating droplets. Rather, the coating material is dispersed under pressure, e.g., discharged from a nozzle under pressure, to form a continuous sheet or wall of non-atomized coating material. As used in this specification and the appended claims, the singular forms "a", "an", and "the" include plural referents unless expressly and unequivocally limited to one referent. Although the invention is described in terms of "a" or "an" or "the", the scope of the invention is not so limited and encompasses the use of more than "a" material, surface, etc., unless expressly and unequivocally limited to one. Also, it is to be understood that a coating formed over an optical article in accordance with the invention can be formed over an entire surface of the article or over a portion (less than all) of the surface.

Exemplary apparatus incorporating features of the invention will first be described and then the use of these exemplary apparatus to coat an article will be described. However, it is to be understood that the specific exemplary embodiments discussed in detail below are provided simply to describe the general concepts of the invention and that the invention is not limited to the specifically described embodiments. Additionally, the invention will be described with reference to coating an optical article, such as a multi-focal optical lens. However, this is simply one exemplary use of the invention. The invention may be used to coat many types of optical articles, such as but not limited to eyeglass lenses, contact lenses, photochromic lenses, or telescopic lenses, just to name a few, of any desired material.

In one non-limiting embodiment, the optical articles produced in accordance with the invention meet commercially acceptable "cosmetic" standards for coated optical articles as known to those skilled in the art. The at least partially cured coated article may be substantially free of visually detectable cosmetic defects. Non-limiting examples of cosmetic defects of a coated optical article include pits, spots, inclusions, cracks, non-uniformity of coating thickness, orange peel, ribbing, wrinkling, and crazing of the coating.

A first coating device 10 incorporating features of the invention is illustrated in FIG. 1. The first coating device 10 includes a framework 12, such as a metal framework, having at least one conveyor. The conveyor(s) may be configured to transport items in a substantially horizontal direction with respect to FIG. 1. In the illustrated embodiment, the coating device 10 includes a first conveyor 14 and a second conveyor 16. The first and second conveyors 14, 16 may be movably mounted on the framework 12 in any conventional manner, such as by rollers or wheels. The first and second conveyors 14, 16 may move at the same or different speeds.

The first coating device 10 further includes a holder 20 configured to support or hold an article 22 to be coated. In one particular embodiment, the holder 20 may be a substantially rectangular metal holder configured to hold the article 22 on the holder 20 during coating. For example, the holder 20 may comprise a depression or cut-out area that may have a surface complementary to the bottom surface of the article 22 such that the article 22 is securely held in the holder 20. The holder 20 may be configured to hold the article 22 in a flat (or horizontal) position or to hold the article 22 at an angle (tilted or angled with respect to horizontal). A receiving platform 26 may be located at the end of the framework 12 to receive the holder 20 and coated article 22 after coating, as described in more detail below.

The first coating device 10 further includes an applicator, such as a pressure-coating applicator. By "pressure-coating applicator" or "pressure coater" is meant a device that propels coating material from the applicator under pressure. In the illustrated embodiment, the coating applicator is a flow coater, such as a fan coater 30, comprising a nozzle 32 in flow communication with a source 36 of coating material. The coating material and the source 36 may be under pressure or, alternatively, the source 36 may be in flow communication with a source 38 of pressurized fluid, such as pressurized air, to maintain the coating material under pressure. As will be appreciated by one skilled in the art, the fan coater nozzle 32 may be shaped and/or configured to provide a fan-shaped or wedge-shaped sheet or stream of non-atomized coating material 40 at a desired pressure. As will be appreciated by one skilled in the coating art, a flow coating device, such as the fan coater 30, provides a contiguous sheet of coating liquid that increases in size (e.g., width or diameter) from the point of discharge. The fan coater nozzle 32 discharges the solid stream of coating liquid in a wedge or fan shape. As opposed to conventional spray coaters, flow coaters do not atomize the discharged liquid but, rather, provide a solid sheet or stream of coating liquid.

The fan coater nozzle 32 may be connected to a movement device 42 configured to move the fan coater nozzle 32 with respect to the conveyors 14, 16. For example, the movement device 42 may raise or lower the nozzle 32, move the nozzle 32 left or right with respect to a direction of movement 44 of the conveyors 14, 16, or tilt the nozzle 32 with respect to the direction of movement 44.

Figure 2:
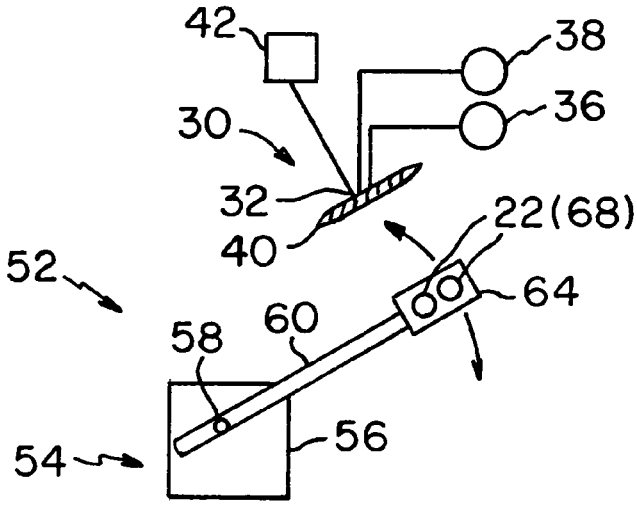
FIG. 2 is a plan view (not to scale) of another coating device of the invention.
Figure 3:
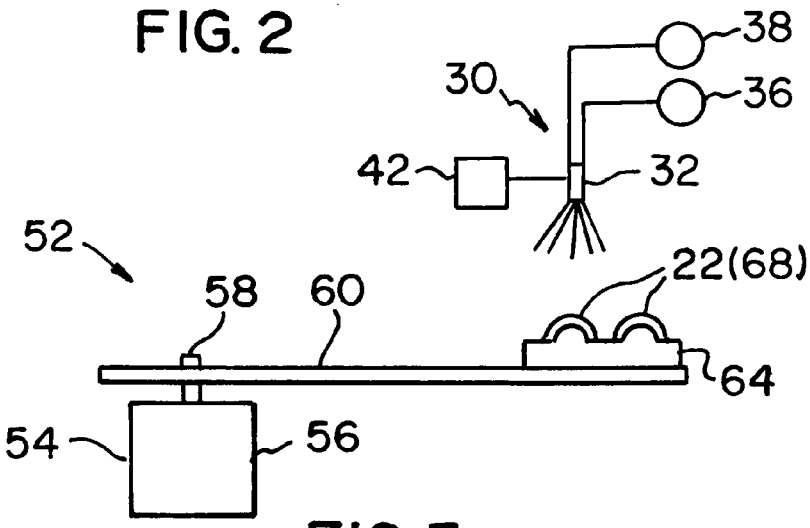
FIG. 3 is a side view (not to scale) of the coating device of FIG. 2.

Another coating device 52 is shown in FIGS. 2 and 3. The coating device 52 includes a pressure-coating applicator, such as a fan coater 30 described above. Additionally, the coating device 52 includes a movement device 54 configured to move an article to be coated in a predetermined path, e.g., curved or non-linear path, through the fan of coating material 40 as described below. In one embodiment, the movement device 54 comprises a motor 56 connected to a rotatable shaft 58. A support, such as an arm 60, is connected to the shaft 58. A holder 64 is carried on the arm 60 at or near the end opposite to the end connected to the shaft 58. The holder 64 may be similar to the holder 20 described above and may be configured to hold one or more articles 22 to be coated.

Operation of the coating devices 10 and 52 will now be described. Referring first to the coating device 10, an article 22 to be coated may be placed in the holder 20. In the broad practice of the invention, the article 22 may be of any desired shape, e.g., flat, curved, or having both flat and curved portions, and may be of any desired dimension, e.g., length, width, or thickness. The article 22 may include any desired material having any desired characteristics. For example, the article 22 may be transparent or translucent to visible light. By "transparent" is meant having visible light transmittance of greater than 0% to 100%. Alternatively, the article 22 may be translucent. By "translucent" is meant allowing electromagnetic energy (e.g., visible light) to pass through but diffusing this energy such that objects on the side opposite the viewer are not clearly visible. The article 22 may be transparent or reflective of infrared or ultraviolet light. Examples of suitable materials include, but are not limited to, plastic substrates (such as acrylic polymers, such as polyacrylates; polyalkylmethacrylates, such as polymethylmethacrylates, polyethylmethacrylates, polypropylmethacrylates, and the like; polyurethanes; polycarbonates; polyalkylterephthalates, such as polyethyleneterephthalate (PET), polypropyleneterephthalates, polybutyleneterephthalates, and the like; polysiloxane-containing polymers; or copolymers of any monomers for preparing these, or any mixtures thereof).

In one non-limiting embodiment, the substrate may be a polymeric organic material, such as thermoset and thermoplastic polymeric organic materials, e.g., thermoplastic polycarbonate-type polymers and copolymers and homopolymers or copolymers of polyol(allyl carbonate) used as organic optical materials.

Non-limiting examples of the aforementioned polymeric organic materials that can be used as substrates in conjunction with various non-limiting embodiments disclosed herein include polymeric materials, for example, homopolymers and copolymers, prepared from the monomers and mixtures of monomers disclosed in U.S. Pat. No. 6,733,887 at column 9, line 55 to column 17, line 7; in U.S. Pat. No. 5,658,501 at column 15, line 28 to column 16, line 17; and U.S. Pat. No. 6,352,747 at column 7, lines 15-53, the disclosures of which U.S. Patents are incorporated herein by reference in their entirety.

In one non-limiting embodiment, the substrate is chosen from glass, ceramic, and polymeric organic materials and is an optical element, e.g., plano and vision correcting ophthalmic lenses, windows, clear polymeric films, automotive transparencies, e.g., windshields, aircraft transparencies, plastic sheeting, etc. In another non-limiting embodiment of the present invention, the substrate is a polymeric organic material, such as optically clear polymerizates, e.g., materials suitable for optical applications, such as optical elements. Such optically clear polymerizates may have a refractive index that may vary widely. Examples of non-limiting embodiments include polymerizates of optical resins such as thermoplastic polycarbonate and optical resins sold by PPG Industries, Inc. as TRIVEX® monomer composition and under the CR- designation, e.g., CR-39® monomer composition.

The substrate, in one non-limiting embodiment, may be obtained as a preformed commercially available article to which the coating is applied, e.g., a glass and/or plastic lens, or the substrate may be produced in a process, e.g., a cast lens, immediately preceding the coating application. In another non-limiting embodiment, the preformed and/or cast lens may be subjected to surfacing and/or machining processes, e.g., front and/or rear surfacing and edging, to adjust the lens to the desired prescription and/or size of the intended frames before and/or after the coating application.

Figure 4:
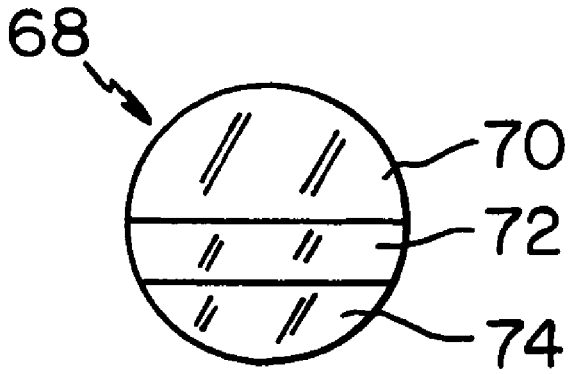
FIG. 4 is a front view (not to scale) of a multi-focal lens.
Figure 5:
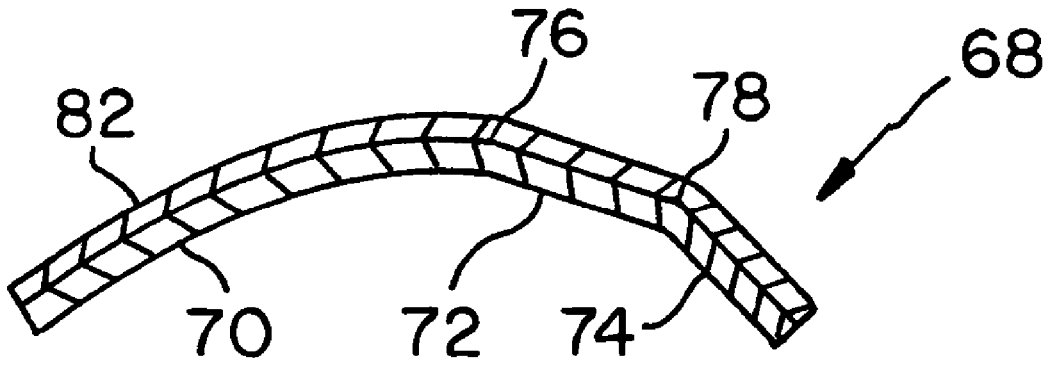
FIG. 5 is a side, sectional view (not to scale) of the lens of FIG. 4.

In one aspect of the invention, the article 22 may be an optical lens, such as multi-focal or non-multi-focal glass or plastic lens, e.g., ophthalmic lens. As shown in FIGS. 4 and 5, a multi-focal lens 68 includes several regions or areas of different focal parameters. The multi-focal lens 68 shown in FIGS. 4 and 5 is configured as a conventional trifocal lens having a first focal region 70, a second focal region 72, and a third focal region 74. As will be appreciated by one skilled in the art, the presence of the differing focal regions means that the lens 68 has a non-uniform or uneven surface, i.e., the outer surface is of non-uniform curvature. Conventional spin coating techniques are not well suited to coat such a multi-focal lens 68 since the presence of the differing focal regions may cause uneven coating thickness, particularly at edges 76 and 78 separating the coating regions 70, 72, and 74. These edges 76, 78 between the adjacent focal regions 70, 72, 74 may either hinder the flow of the coating material across the lens surface in a conventional spin coating technique or may cause irregularities in the coating thickness on the lens surface. However, the practice of the invention provides a lens having a coating 82 of substantially uniform thickness across the outer surface of the lens 68 (as shown in FIG. 5) even though the lens has a non-uniform curvature.

However, it is to be appreciated that the invention is not limited to use with multi-focal lenses. The invention could also be practiced on conventional non-multi-focal lenses, i.e., lenses having a single focal prescription rather than a bifocal or trifocal lens. Moreover, the invention is not limited to use with optical lenses. Examples of other optical articles that may be coated in the practice of the invention include motorcycle helmet visors, protective sports visors, goggles, binocular lenses, and telescope lenses, just to name a few.

In one aspect of the invention with respect to the first coating device 10, a lens 68 may be placed in the holder 20. The fan coater 30 may be activated to provide a fan-shaped sheet of non-atomized coating material 40 at a desired set of application parameters, as described below. The conveyors 14 and 16 may be activated and set to desired speeds and the holder 20 may be placed on the first conveyor 14. The first conveyor 14 transports the holder 20 in a predetermined path, e.g., along the movement direction 44, into the sheet of coating material 40 to apply the coating material over the article 22, onto the second conveyor 16, and then onto the receiving platform 26. As will be appreciated by one skilled in the art, the coated article 22 may be further processed, such as by heating or in other conventional ways, to cure or at least partially cure the applied coating material before or after the coated article 22 is removed from the holder 20. The phrase "at least partially cure" refers to a coating in which some to all of the curable components of the coating are cured, e.g., reacted or polymerized.

In the broad practice of the invention, the coating material applied over the article 22 may be of any desired type. In one non-limiting embodiment in which the article, 22 is an optical lens, the coating material may be any coating material conventionally applied to such lenses, such as a polymeric coating. For example, the coating material may be selected to provide a scratch-resistant or mar-resistant coating, an antireflective coating, a photochromic coating, an infrared or ultraviolet reflective coating, a polarization coating, an antistatic coating, or a temporary protective coating, just to name a few. Non-limiting examples of scratch-resistant coatings are described in, but are not limited to, U.S. Patent Publication Nos. 20040096666 (page 6, paragraph 68 to page 16, paragraph 148); 20040156983 (page 3, paragraph 37 to page 4, paragraph 56); and U.S. Pat. No. 6,680,125 (column 2, line 65 to column 10, line 33). Non-limiting examples of antireflective coatings are described in U.S. Pat. Nos. 6,632,535 (column 69, line 19 to column 74, line 50); 6,605,361 (column 2, line 51 to column 10, line 11); U.S. Patent Publication Nos. 20040234780 (page 2, paragraph 4 to page 3, paragraph 50 and page 4, paragraph 71 to page 6, paragraph 94); and 20040201822 (page 2, paragraph 25). Non-limiting examples of temporary protective coatings are described in U.S. Pat. No. 6,761,784 (column 3, line 17 to column 7, line 13). Non-limiting examples of photochromic coatings are disclosed in U.S. Pat. No. 6,352,747 (column 4, lines 12-61); U.S. Patent Publication Nos. 20040207809 (page 5, paragraph 48 to page 11, paragraph 105); and 20040173782 (page 2, paragraph 28 to page 19, paragraph 195).

In the various non-limiting embodiments of the present invention, the exact nature of the coating composition forming the coating material is not critical. In one non-limiting embodiment, the coating composition comprises a film-forming polymer. In another non-limiting embodiment, the coating composition used to produce the coated articles of the present invention comprises compositions adapted to provide thermoplastic or thermosetting coatings that are described in the *Kirk-Othmer Encyclopedia of Chemical Technology*, Fourth Edition, Volume 6, pages 669 to 760. Such coatings may be transparent, translucent or opaque. In a further non-limiting embodiment, the coating is one that upon at least partial curing forms a polymeric coating chosen from polyurethanes, aminoplast resins, silanes, poly(meth)acrylates, e.g., polyacrylates and polymethacrylates, polyanhydrides, polyacrylamides, and epoxy resins.

In one exemplary application method, the nozzle 32 is positioned above the conveyors 14 and 16 such that the article 22 is at a distance in the range of 1 inch to 10 inches (2.5 cm to 25 cm), such as 2 inches to 7 inches (5 cm to 17.7 cm), such as 3 inches to 6 inches (7.6 cm to 15.2 cm), such as 5 inches (12.7 cm) from the nozzle 32 when the holder 20 passes through the fan of coating material 40. The conveyors 14 and/or 16 may rotate at speeds such that the holder 20 is conveyed through the fan of coating material 40 at a speed in the range of 100 feet per minute to 1200 feet per minute (30.4 meters per minute to 360 meters per minute), such as 100 feet per minute to 800 feet per minute (30.4 meters per minute to 243.2 meters per minute), such as 200 feet per minute to 700 feet per minute (60.8 meters per minute to 212.8 meters per minute), such as 300 feet per minute to 600 feet per minute (91.2 meters per minute to 182.4 meters per minute), such as 500 feet per minute (152 meters per minute). The coating material 40 may be supplied to the nozzle 32 at a viscosity in the range of 20 centipoise to 400 centipoise (cp), such as 50 cp to 200 cp. The coating material 40 may be discharged at a nozzle pressure in the range of 2 psi to 30 psi (140 grams per square centimeter to 2109 grams per square centimeter). In one non-limiting embodiment, the fan of coating material 40 may have a fan width in the range of 4 inches to 10 inches (10.2 cm to 25.4 cm), such as 5 inches to 7 inches (12.7 cm to 17.8 cm), such as 6.5 inches (16.5 cm) at the position where the holder 20 passes through the fan of coating material 40. By "fan width" is meant the lateral width of the fan-shaped sheet of coating material 40. The holder 20 may be positioned on the conveyors 14 and 16 such that the holder 20 passes through the center of the fan of coating materials 40. However, in one non-limiting embodiment, the holder 20 may be offset on the conveyors 14 and 16 such that the holder 20 passes through the fan of coating material 40 at a fan offset. By "fan offset" is meant the lateral distance of the holder 20 from the center of the fan of coating material 40. In one non-limiting embodiment, the fan offset may be in the range of 0.5 inch to 4 inches (1.3 cm to 10 cm), such as 1 inch to 2 inches (2.54 cm to 5.1 cm), such as 1.5 inches (3.8 cm). In another non-limiting embodiment, the nozzle 32 may be positioned at an angle with respect to the movement direction 44 such that the fan of coating material 40 is directed at the holder 20 at a coating angle 90 in the range of ±45° with respect to a vertical axis V perpendicular to the direction of travel 44 (i.e., 90° from the direction of travel 44), such as ±30°, such as ±25°, such as ±20°, such as ±15°, such as ±10°, such as ±5°, such as ±0°. For example, by "−25°" is meant that the nozzle 32 would be tilted to the left in FIG. 1 by 25° from a vertical axis V. By "+25°" would mean that the nozzle 32 would be tilted to the right in FIG. 1 by 25° from the vertical axis V.

In a further non-limiting embodiment, the thickness of the aforedescribed coating may vary widely. In one non-limiting embodiment, the at least partially cured coating may have a thickness of from 1 to 10,000 microns. In another non-limiting embodiment, the coating thickness may be from 5 to 1,000 microns. In a further non-limiting embodiment, the coating thickness may be from 10 to 400 microns, e.g., 30 microns.

Operation of the coating device 52 will now be described. An article 22 may be placed in the holder 64. The fan coater 30 may be activated to provide a fan-shaped sheet of non-atomized coating material 40. The motor 56 may be activated to turn the arm 60 to cause the holder 64 to pass through the fan of coating material 40 in a predetermined path, such as a curved path, as shown particularly in FIG. 2. The holder 64 may pass through the sheet of coating material 40 once or several times while rotating in one direction or, the arm 60 may pass through the sheet of coating material 40 in one direction and then the motor 56 may be reversed to cause the holder 64 to pass through the coating sheet in the opposite direction. The coating deposition parameters, coating thickness, etc. may be as described above for the coating device 10. As in the above-described embodiment 10, the article 22 may be positioned horizontally in the holder 64. Alternatively, the holder 64 and/or the article 22 may be tilted or angled such that the article 22 passes through the sheet of coating material 40 at an angle from horizontal, such as an angle from 0° to 90° with respect to horizontal.

It will be readily appreciated by those skilled in the art that modifications may be made to the invention without departing from the concepts disclosed in the foregoing description. For example, multiple coatings may be applied over the optical article in the practice of the invention. Moreover, the holder may be configured to rotate the article during coating or the holder may be rotated during coating. Furthermore, in the above non-limiting embodiments, the article was passed through the sheet of coating material. However, it is also within the scope of the invention to maintain the article stationary and pass the coating sheet over the article or even to move both the article and the coating sheet during the coating process. Accordingly, the particular embodiments described in detail herein are illustrative only and are not limiting to the scope of the invention, which is to be given the full breadth of the appended claims and any and all equivalents thereof.

What is claimed is:

1. Apparatus for coating an optical article, the apparatus comprising:

(a) a supporting framework;

(b) first and second conveyor devices moveably mounted on said supporting framework;

(c) a pressure coater positioned between said first and second conveyor devices and comprising a nozzle in flow communication with a source of coating material, said nozzle being configured to supply a wedge-shaped solid stream of non-atomized coating material at a pressure of 2 to 30 psi in a downwardly direction;

(d) a holder on said first conveyor device, said holder being configured to hold an optical article; and (e) a movement device configured to rotate said first and second conveyor devices, thereby to transport the holder along a predetermined path extending from said first conveyor device to beneath said pressure coater and to said second conveyor device.

2. The apparatus of claim 1, wherein the pressure coater is a fan coater.

3. The apparatus of claim 1, wherein the optical article is an optical lens.

4. The apparatus of claim 1, wherein the first and second conveyor devices are configured to move the holder in a substantially straight path through the coating material.

5. The apparatus of claim 4, wherein the first and second conveyor devices are configured to move the holder in a substantially curved path through the coating material.

6. The apparatus of claim 3 wherein the wedge-shaped stream of coating material has a width of from 4 to 10 inches where the holder passes through the coating material.

7. The apparatus of claim 6 wherein the holder is offset from 0.5 to 4 inches from the center of the pressure coater nozzle.

* * * * *